US010152005B2

(12) United States Patent
Yokoyama et al.

(10) Patent No.: US 10,152,005 B2
(45) Date of Patent: Dec. 11, 2018

(54) FIXING DEVICE AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Shuji Yokoyama, Sunto Shizuoka (JP); Yuki Kawashima, Tagata Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 4 days.

(21) Appl. No.: 15/466,058

(22) Filed: Mar. 22, 2017

(65) Prior Publication Data

US 2018/0224776 A1 Aug. 9, 2018

(30) Foreign Application Priority Data

Feb. 6, 2017 (JP) ..... 2017-019400

(51) Int. Cl.
*G03G 15/20* (2006.01)

(52) U.S. Cl.
CPC ..... *G03G 15/2053* (2013.01)

(58) Field of Classification Search
None
See application file for complete search history.

(56) References Cited

U.S. PATENT DOCUMENTS

2003/0227533 A1* 12/2003 Yokoi ..... B41J 11/002 347/156
2006/0285893 A1* 12/2006 Ishii ..... G03G 15/2039 399/329
2012/0251157 A1* 10/2012 Tanda ..... G03G 15/2032 399/94
2015/0286176 A1* 10/2015 Shibata ..... G03G 15/2017 399/329
2017/0308010 A1* 10/2017 Okajima ..... G03G 15/2053

FOREIGN PATENT DOCUMENTS

JP 2014-109714 6/2014

* cited by examiner

*Primary Examiner* — Thomas Giampaolo, II
(74) *Attorney, Agent, or Firm* — Amin, Turocy & Watson LLP

(57) ABSTRACT

A supporting shaft extending in the direction of A heating unit is provided on A plate. A first bracket configured to support, on the supporting shaft, a center portion in a longitudinal direction of the heating unit and allow the heating unit to move in a rotating direction and a vertical direction with respect to the plate is provided in the heating unit. Receivers are provided at both end portions in the longitudinal direction in one unit of the heating unit and A fuser unit. Inserters are provided in the other unit to be opposed to the receivers. If the fuser unit is attached to the plate, the inserters are coupled to the receivers to restrict the heating unit from moving in the rotating direction and the vertical direction.

9 Claims, 8 Drawing Sheets

FIXING DEVICE AND IMAGE FORMING APPARATUS

CROSS-REFERENCE TO RELATED APPLICATION

This application is based upon and claims the benefit of priority from Japanese Patent Application No. 2017-019400, filed Feb. 6, 2017, the entire contents of which are incorporated herein by reference.

FIELD

Embodiments described herein relate generally to a fixing device that fixes a toner image on a recording medium such as a sheet and an image forming apparatus that forms an image on the recording medium using the fixing device.

BACKGROUND

There has been known an image forming apparatus that forms an image on a recording medium (e.g., a sheet), which is a printing target object. The image forming apparatus transfers a toner image onto a sheet supplied to a transfer section. The sheet having the toner image transferred thereon is heated and pressurized by a fixing device. The toner image is fixed on the sheet.

The fixing device includes a fixing belt and a pressurizing roller opposed to the fixing belt and configured to apply pressure to the sheet. Further, the fixing device includes an electromagnetic induction heating coil unit (IH coil unit) in order to heat the fixing belt. The fixing device holds the sheet between the heated fixing belt and the pressurizing roller and conveys the sheet, applies heat and pressure to the sheet to melt toner, and fixes the toner image on the sheet (JP-A-2014-109714 (Patent Literature 1)).

The fixing device is provided in a main body of the image forming apparatus. In order to cause the fixing device to efficiently generate heat, a relative positional relation of the IH coil unit with the fixing belt is important. Therefore, it is necessary to appropriately arrange the IH coil unit with respect to the fixing belt.

DETAILED DESCRIPTION

Figure 1:
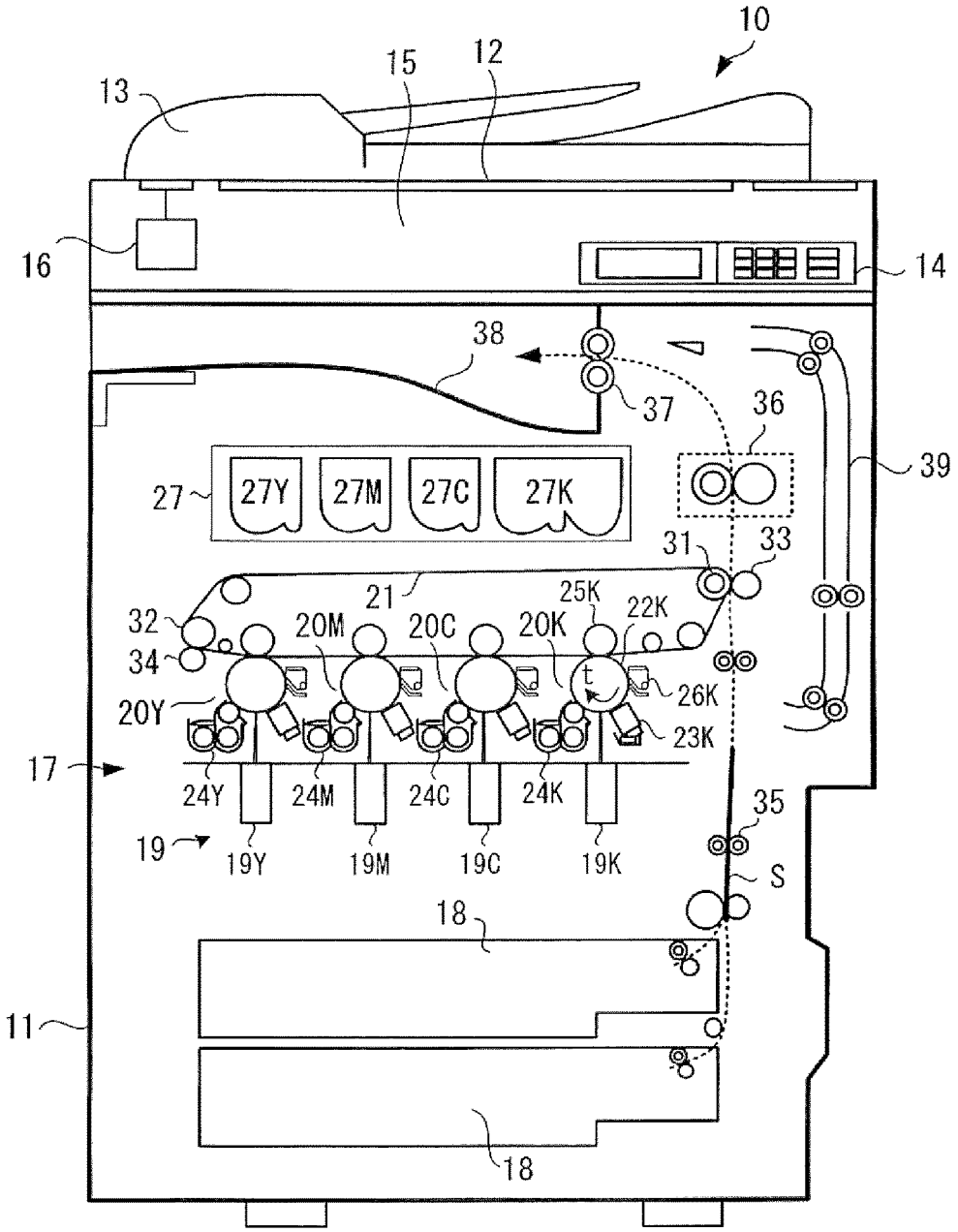
FIG. 1 is a configuration diagram showing an image forming apparatus according to an embodiment.

An object of embodiments described herein is to provide a fixing device in which a fuser unit and an IH coil unit can be accurately positioned and the fuser unit can be smoothly attached.

In general, according to one embodiment, a fixing device includes: a fuser unit including a cylindrical rotating body; a heating unit disposed along a longitudinal direction of the rotating body and configured to heat the rotating body; a plate to which the heating unit and the fuser unit can be attached; a supporting shaft provided on the plate to extend in a direction of the heating unit; a bracket provided in the heating unit and configured to support, on the supporting shaft, a center portion in the longitudinal direction of the heating unit and allow the heating unit to move in a rotating direction using the supporting shaft as a fulcrum and a vertical direction with respect to the plate; and a positioning member including receivers provided at both end portions in the longitudinal direction of one unit of the heating unit and the fuser unit and inserters provided in positions of the other unit opposed to the receivers, if the fuser unit is attached to the plate, the inserters being coupled to the receivers to restrict the heating unit from moving in the rotating direction and the vertical direction.

Embodiments are explained below with reference to the drawings. Note that, in the figures, the same portions are denoted by the same reference numerals and signs.

First Embodiment

FIG. 1 is a configuration diagram showing an image forming apparatus according to an embodiment. In FIG. 1, an image forming apparatus 10 is, for example, an MFP (Multi-Function Peripherals), which is a composite machine, a printer, or a copying machine. In the following explanation, the MFP is explained as an example.

An original document table 12 of transparent glass is present in an upper part of a main body 11 of the MFP 10. An automatic document feeder (ADF) 13 is openably and closably provided on the original document table 12. An operation panel 14 is provided in an upper part of the main body 11. The operation panel 14 includes various keys and a display section of a touch panel type.

A scanner section 15, which is an image reading section, is provided under the ADF 13 in the main body 11. The scanner section 15 reads an original document sent by the ADF 13 or an original document placed on the original document table 12 and generates image data. The scanner section 15 includes an image sensor 16. The image sensor 16 is disposed in a main scanning direction (in FIG. 1, a depth direction).

Further, the MFP 10 includes, in the center portion in the main body 11, a printer section 17 configuring an image forming section. The MFP 10 includes, in a lower part of the main body 11, a plurality of cassettes 18 that store sheets of various sizes. The printer section 17 includes a photoconductive drum, an exposing section, and the like. The exposing section includes a scanning head 19 including an LED, which is a light emitting element. The printer section 17 scans the photoconductive drum with a ray emitted from the scanning head 19 and generates an image.

The printer section 17 processes image data read by the scanner section 15 or image data created by a PC (Personal Computer) or the like and forms an image on a recording medium, which is a printing target object. In the following explanation, as an example, a sheet S is used as the recording medium. However, an OHP sheet and the like can also be used as the recording medium.

The printer section 17 is, for example, a color laser printer by a tandem system. The printer section 17 includes image forming stations 20Y, 20M, 20C, and 20K of respective colors of yellow (Y), magenta (M), cyan (C), and black (K). The image forming stations 20Y, 20M, 20C, and 20K are disposed in parallel from an upstream side to a downstream side on the lower side of an intermediate transfer belt 21. In the scanning head 19, a plurality of scanning heads 19Y, 19M, 19C, and 19K are provided in the main scanning direction to correspond to the image forming stations 20Y, 20M, 20C, and 20K.

The image forming stations 20Y, 20M, 20C, and 20K have the same configuration. Therefore, the image forming station 20K is representatively explained. The image forming station 20K includes a photoconductive drum 22K, which is an image bearing body. An electrifying charger 23K, a developing device 24K, a primary transfer roller 25K, a cleaner 26K, and the like are disposed around the photoconductive drum 22K along a rotating direction t of the photoconductive drum 22K. Light is irradiated on an exposure position of the photoconductive drum 22K from the scanning head 19K. An electrostatic latent image is born on the photoconductive drum 22K.

The electrifying charger 23K uniformly charges the entire surface of the photoconductive drum 22K. The developing device 24K supplies, with a developing roller to which a developing bias is applied, a two-component developer including black toner and a carrier to the photoconductive drum 22K. A toner image is formed on the photoconductive drum 22K. The cleaner 26K removes residual toner on the surface of the photoconductive drum 22K.

A toner cartridge 27 for supplying toners to developing devices 24Y to 24K is provided above the image forming stations 20Y to 20K. The toner cartridge 27 includes toner cartridges 27Y, 27M, 27C, and 27K of the respective colors of yellow (Y), magenta (M), cyan (C), and black (K).

The intermediate transfer belt 21 is stretched and suspended between a driving roller 31 and a driven roller 32 and cyclically moves. The intermediate transfer belt 21 is opposed to and in contact with the photoconductive drum 22K. The primary transfer roller 25K is provided in a position of the intermediate transfer belt 21 opposed to the photoconductive drum 22K. A primary transfer voltage is applied to the intermediate transfer belt 21 by the primary transfer roller 25K. The toner image on the photoconductive drum 22K is primarily transferred onto the intermediate transfer belt 21.

A secondary transfer roller 33 is disposed to be opposed to the driving roller 31 that stretches and suspends the intermediate transfer belt 21. If the sheet S passes between the driving roller 31 and the secondary transfer roller 33, a secondary transfer voltage is applied to the sheet S by the secondary transfer roller 33. The toner image on the intermediate transfer belt 21 is secondarily transferred onto the sheet S. A belt cleaner 34 is provided near the driven roller 32 of the intermediate transfer belt 21.

The scanning head 19K is opposed to the photoconductive drum 22K and functions as an exposing section. The photoconductive drum 22K rotates at rotating speed set in advance and accumulates electric charges on the surface of the photoconductive drum 22K. The light from the scanning head 19K is irradiated on the photoconductive drum 22K to expose the photoconductive drum 22K to form an electrostatic latent image on the surface of the photoconductive drum 22K. Similarly, the scanning heads 19Y, 19M, and 19C form electrostatic latent images on the surfaces of the photoconductive drums of the image forming stations 20Y, 20M, and 20C corresponding to the scanning heads 19Y, 19M, and 19C.

Note that, as the exposing section of the photoconductive drum 22, a laser exposing device may be used instead of the scanning head 19. The laser exposing device scans a laser beam, which is emitted from a semiconductor laser element, in the main scanning direction of photoconductive drums 22K to 22C using a polygon mirror.

As shown in FIG. 1, conveying rollers 35 are provided between the paper feeding cassettes 18 and the secondary transfer roller 33. The conveying rollers 35 convey the sheet S taken out from the paper feeding cassettes 18. Further, a fixing device 36 is provided downstream of the secondary transfer roller 33. As explained below, the fixing device 36 includes an IH coil unit, a fixing belt, and a pressurizing roller opposed to the fixing belt and configured to apply pressure to the sheet S. The fixing device 36 holds the sheet S between the heated fixing belt and the pressurizing roller, applies heat and pressure to the sheet S to melt toner, and fixes a toner image on the sheet S.

A conveying roller 37 is provided downstream of the fixing device 36. The conveying roller 37 discharges the sheet S to a paper discharging section 38. Further, a reverse conveying path 39 is provided downstream of the fixing device 36. The sheet S is once conveyed in the direction of the paper discharging section 38 and the conveying roller 37 is reversely rotated, whereby the sheet S is switched back and conveyed to the reverse conveying path 39. The reverse conveying path 39 reverses the sheet S and guides the sheet S in the direction of the secondary transfer roller 33. The reverse conveying path 39 is used if duplex printing is performed.

Note that the printer section 17 of the image forming apparatus 10 is not limited to the tandem system and may be other systems. The number of developing devices 24 is not limited to four.

Figure 2:
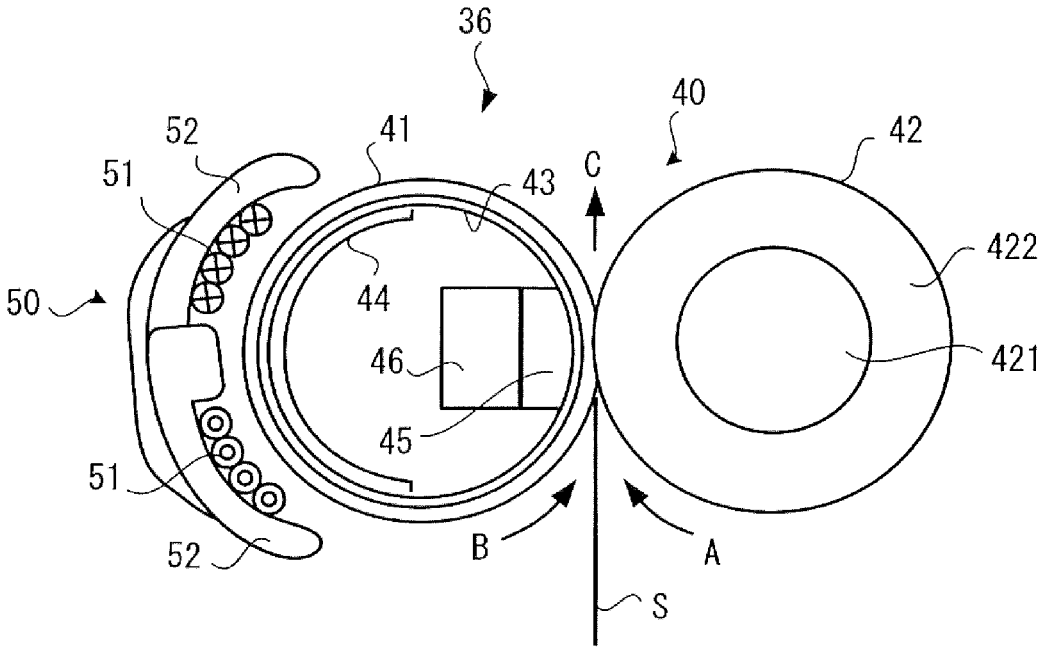
FIG. 2 is a schematic configuration diagram of a fixing device according to the embodiment viewed from a side.

The fixing device 36 according to the embodiment is explained with reference to FIG. 2. FIG. 2 is a schematic configuration diagram of the fixing device 36 viewed from a side.

As shown in FIG. 2, the fixing device 36 includes a fuser unit 40 and an electromagnetic induction heating coil unit 50. The fuser unit 40 includes a fixing belt 41 and a pressurizing roller 42. The electromagnetic induction heating coil unit 50 configures a heating unit and is hereinafter referred to as IH coil unit 50.

The fixing belt 41 of the fuser unit 40 is an endless cylindrical rotating body including a conductive layer. The pressurizing roller 42 is a pressurizing rotating member. The pressurizing roller 42 rotates around rotating shafts provided at both ends.

The fixing belt 41 includes a layer induced by a magnetic field of the IH coil unit 50 to generate heat, for example, a conductive layer 43 formed of a conductive material such as iron, nickel, or copper. Alternatively, a copper layer may be stacked on a nickel layer. The fixing belt 41 includes, on the surface of the conductive layer 43, an elastic layer formed of an elastic body such as silicon rubber and includes, on the surface of the elastic layer, a release layer having good releasability from the toner.

On the inner side of the fixing belt 41, a magnetic member 44 is disposed to be opposed to the IH coil unit 50. A high-frequency current is fed to a coil of the IH coil unit 50 to generate a magnetic flux in the direction of the fixing belt 41. The conductive layer of the fixing belt 41 generates an eddy-current to generate heat with the magnetic flux generated by the IH coil unit 50 and heats the fixing belt 41.

The fuser unit 40 includes a pressurizing pad 45 and a supporting member 46 on the inside of the fixing belt 41.

The pressurizing pad 45 is a pressurizing member and formed by an aluminum member, a metal member applied with coating, or the like. The supporting member 46 supports the pressurizing pad 45 and presses the pressurizing pad 45 against the fixing belt 41. The pressurizing pad 45 is present in a position opposed to the pressurizing roller 42 across the fixing belt 41. The fixing belt 41 is pressed from the inner circumferential portion in the direction of the pressurizing roller 42 by the pressurizing pad 45 to form a nip section between the fixing belt 41 and the pressurizing roller 42.

The pressurizing roller 42 includes an elastic layer 422 such as a heat resistant rubber layer around a core material 421 made of metal. The pressurizing roller 42 is disposed to be opposed to the fixing belt 41 along the axial direction of the fixing belt 41. The fixing belt 41 rotates together with the pressurizing roller 42 according to the rotation of the pressurizing roller 42. The fixing device 36 holds the sheet S between the pressurizing roller 42 and the fixing belt 41 and conveys the sheet S.

The IH coil unit 50 is disposed in the outer circumference of the fixing belt 41. The IH coil unit 50 includes a coil 51 and a core 52 that covers the outer circumference of the coil 51 and restricts a magnetic flux of the coil 51.

The fixing device 36 drives to rotate the rotating shafts of the pressurizing roller 42 with a motor. If the pressurizing roller 42 rotates, the fixing belt 41 rotates following the pressurizing roller 42. For example, if the pressurizing roller 42 rotates in an arrow A direction in FIG. 2, the fixing belt 41 rotates in an arrow B direction.

The fixing device 36 holds the sheet S in the nip section between the fixing belt 41 and the pressurizing roller 42 and conveys the sheet S in an arrow S direction. Therefore, the fixing device 36 applies heat and pressure to the sheet S to melt toner and fixes a toner image on the sheet S. An intermediate region in the axial direction of the fixing belt 41 is free and in a tensionless state. The intermediate region comes into contact with the pressurizing roller 42 in the position of the pressurizing pad 45 to be pressurized and deformed.

Incidentally, if the IH coil unit 50 is retained on the main body side of the image forming apparatus 10, it is difficult to perform restriction of the position of the IH coil unit 50. The embodiment provides a configuration in which the IH coil unit 50 is attached to the main body side of the image forming apparatus 10 and, if the fuser unit 40 is attached, the IH coil unit 50 and the fuser unit 40 can be relatively positioned.

In the following explanation, specific configurations of the fuser unit 40 and the IH coil unit 50 of the fixing device 36 according to the embodiment are explained.

Figure 3:
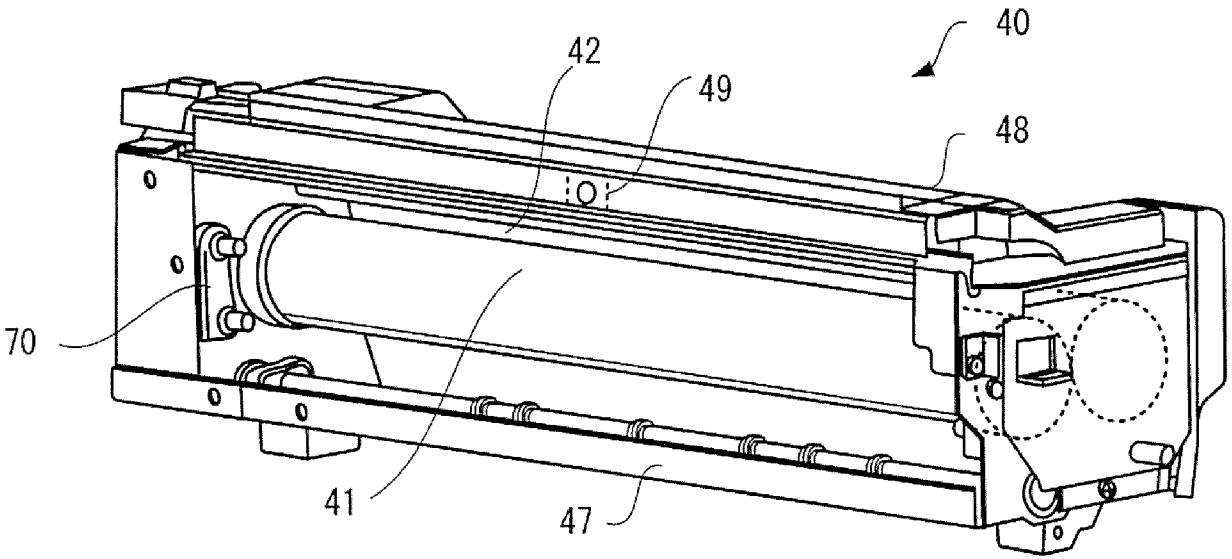
FIG. 3 is a perspective view showing a fuser unit in the embodiment.

FIG. 3 is a perspective view showing the fuser unit 40 and is a view of the fuser unit 40 viewed from the IH coil unit 50 side. The fuser unit 40 includes a frame 47. The fixing belt 41 and the pressurizing roller 42 are rotatably attached to the frame 47. Surfaces other than a surface on the fixing belt 41 side of the pressurizing roller 42 attached to the frame 47 are covered with a cover 48. The fuser unit 40 is fixed to a plate 60 (explained below) in the main body of the image forming apparatus 10 using an attaching mechanism.

Figure 4:
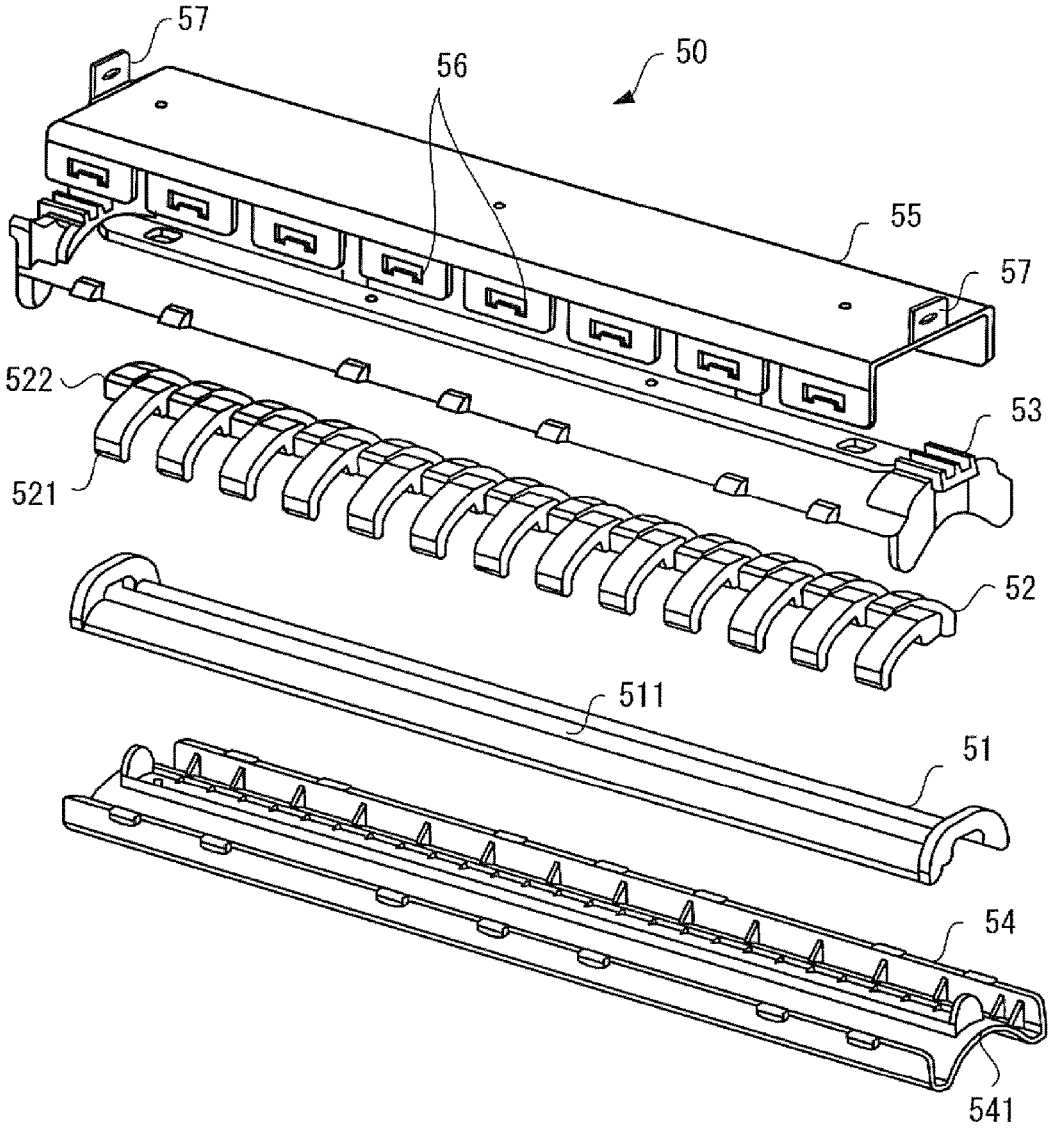
FIG. 4 is an exploded perspective view showing the configuration of an IH coil unit in the embodiment.

FIG. 4 is an exploded perspective view of the IH coil unit 50. In FIG. 4, the IH coil unit 50 includes the coil 51 and the core 52. The coil 51 is formed by winding a conductive coil in the longitudinal direction. The coil 51 includes a window section 511 in the center. The coil 51 generates a magnetic flux according to application of a high-frequency current.

In the core 52, pluralities of first ferrite cores 521 and second ferrite cores 522 extending to the left and right in a wing shape are alternately disposed side by side in the longitudinal direction. The center portion in the longitudinal direction of the core 52 configured by arranging the ferrite cores 521 and the ferrite cores 522 is inserted into the window section 511 of the coil 51.

In FIG. 4, an upper part of the core 52 is covered with a first cover 53 and a lower part of the coil 51 is covered with a second cover 54. Therefore, the coil 51 and the core 52 are configured in the first cover 53 and the second cover 54.

Further, an upper part of the first cover 53 is covered with a shield cover 55. The shield cover 55 is made of, for example, aluminum. The shield cover 55 includes a main body extending in the longitudinal direction and a plurality of claws 56 formed in the longitudinal direction on a side surface of the main body. The shield cover 55 includes, at both end portions in the longitudinal direction of the main body, fins 57 projecting in the opposite direction of the claws 56. The shield cover 55 covers the first cover 53, the core 52, and the coil 51. Further, the shield cover 55 covers the second cover 54 leaving a surface opposed to the fixing belt 41. Consequently, the shield cover 55 prevents a magnetic flux of the coil 51 from leaking to the periphery. Note that an opposed surface 541 of the second cover 54 opposed to the fixing belt 41 is bent in an arcuate shape.

Figure 5:
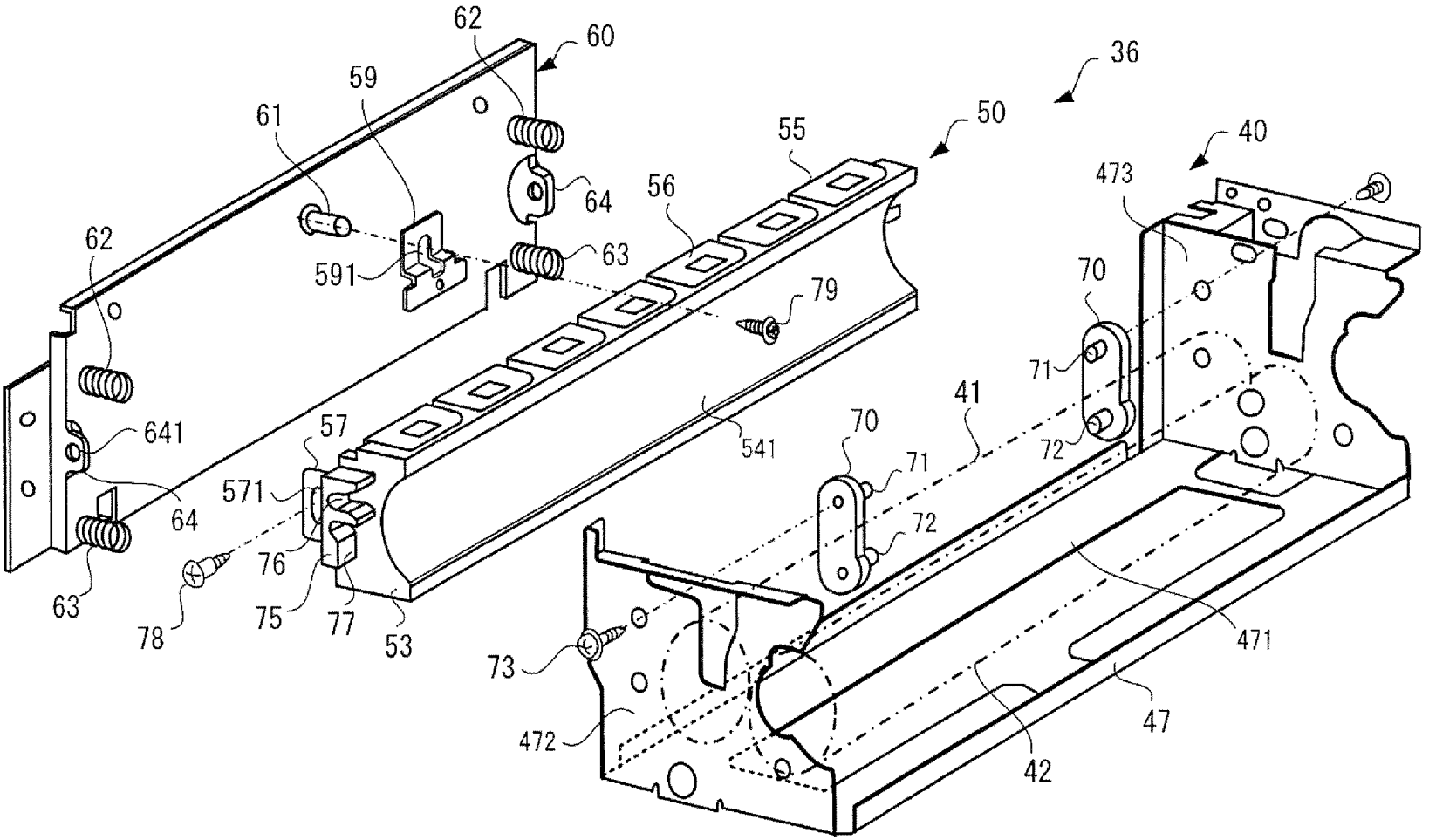
FIG. 5 is an exploded perspective view showing the configuration of a main part of the fixing device.

FIG. 5 is an exploded perspective view showing the configuration of a main part of the fixing device 36 according to the embodiment. In FIG. 5, the fuser unit 40, the IH coil unit 50, and the plate 60 provided in the main body of the image forming apparatus 10 are shown. Note that, in the fuser unit 40, the frame 47 is mainly shown in order to clearly show the configuration.

The frame 47 of the fuser unit 40 includes side surface sections 472 and 473 at both ends in the longitudinal direction of a bottom surface section 471. The side surface sections 472 and 473 are orthogonal to the bottom surface section 471. The fixing belt 41 and the pressurizing roller 42 (indicated by an alternate long and short dash line) are attached in the axial direction between one side surface section 472 and the other side surface section 473.

Inserters 70 are respectively attached to the inner surfaces on the IH coil unit 50 side of one side surface section 472 and the other side surface section 473. The inserters 70 include upper and lower shafts 71 and 72 in parallel. The shafts 71 and 72 of the inserter 70 attached to the side surface section 472 and the shafts 71 and 72 of the inserter 70 attached to the side surface section 473 are attached by screws 73 and the like to face each other.

In the IH coil unit 50, the arcuate surface 541 of the cover 54 is opposed to the fixing belt 41 side. The opposite side of the arcuate surface 541 is covered with the shield cover 55. The claws 56 of the shield cover 55 extend to the fixing roller 41 side. The fins 57 project to the plate 60 side.

F-shaped receivers 75 are provided on side surfaces at both ends in the longitudinal direction of the IH coil unit 50. For example, the receivers 75 are integrally formed on side surfaces of the first cover 53. Alternatively, the receivers 75 may be attached to the side surfaces of the first cover 53 as separate components. The receivers 75 are present in positions opposed to the inserters 70. The receivers 75 include bearings 76 that receive the shafts 71 of the inserters 70 and receiving sections 77 pressed by the shafts 72. That is, the receivers 75 and the inserters 70 configure positioning members.

A bracket 59 is attached to a rear surface of the center portion in the longitudinal direction of the IH coil unit 50. The bracket 59 includes a long hole 591 in the height direction of the center portion. The bracket 59 is fixed to the rear surface of the IH coil unit 50 by screws and the like. Alternatively, the bracket 59 may be provided integrally with the shield case 55.

Further, long holes 571 are formed in the fins 57 provided on both side surfaces of the IH coil unit 50. Stepped screws 78 are inserted into the long holes 571. The screws 78 are fixed to erected pieces 64 of the plate 60 explained below.

The IH coil unit 50 is attached to the plate 60. A center shaft 61 functioning as a supporting shaft is attached to an upper end of the center portion in the longitudinal direction of the plate 60. The center shaft 61 is present in a position opposed to the bracket 59 of the IH coil unit 50. The center shaft 61 pierces through the long hole 591 and projects to the fuser unit 40 side.

A plurality of coil-like springs 62 are attached to a surface present in an upper part of the plate 60 and opposed to the IH coil unit 50. A plurality of coil-like springs 63 are attached to a lower part of the plate 60. The erected pieces 64 are formed at both end portions in the longitudinal direction of the plate 60. The erected pieces 64 include screw holes 641. The erected pieces 64 are formed to correspond to the positions of the fins 57 of the IH coil unit 50.

Figure 6:
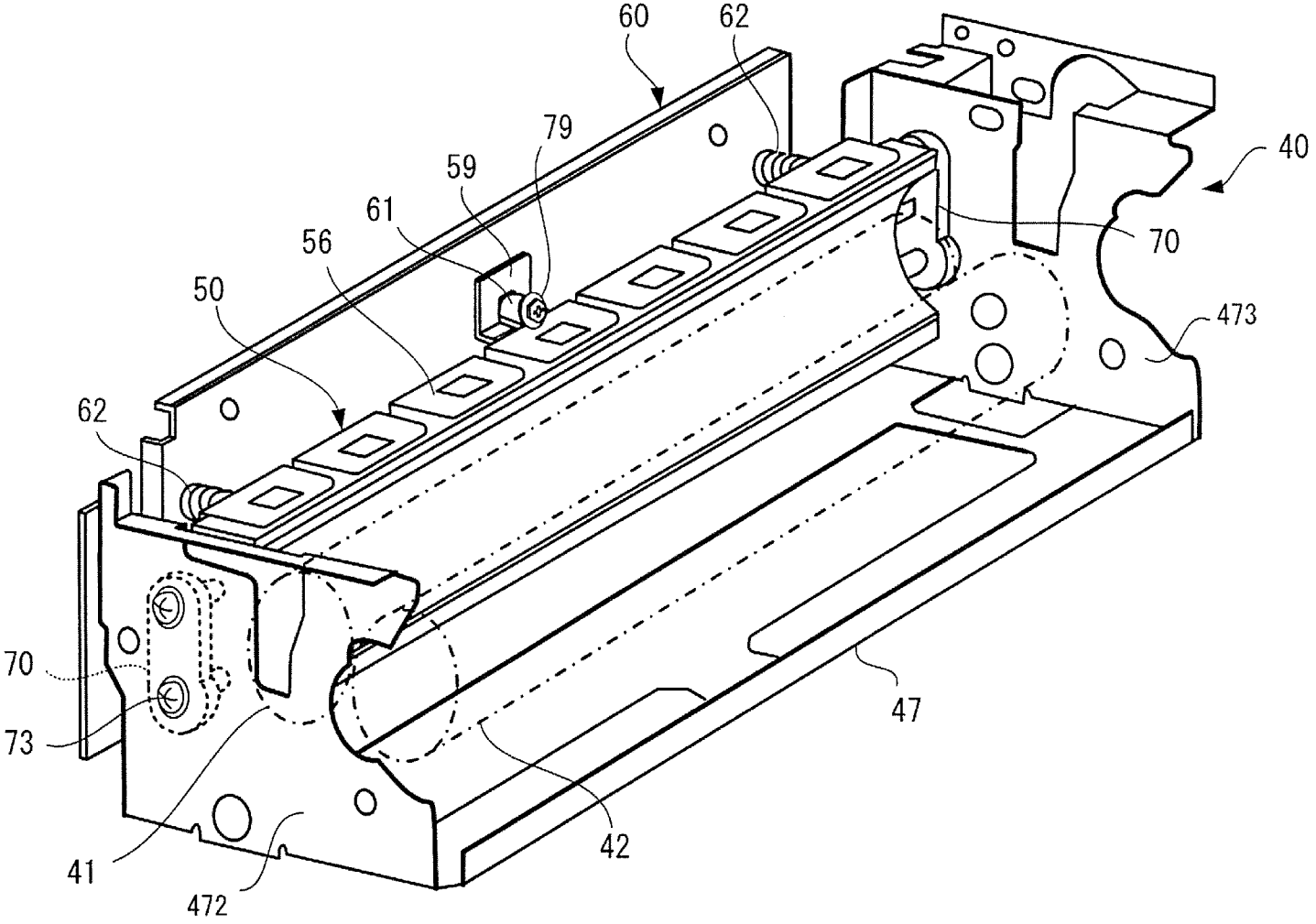
FIG. 6 is a perspective view showing a state in which the main part of the fixing device is assembled.
Figure 7:
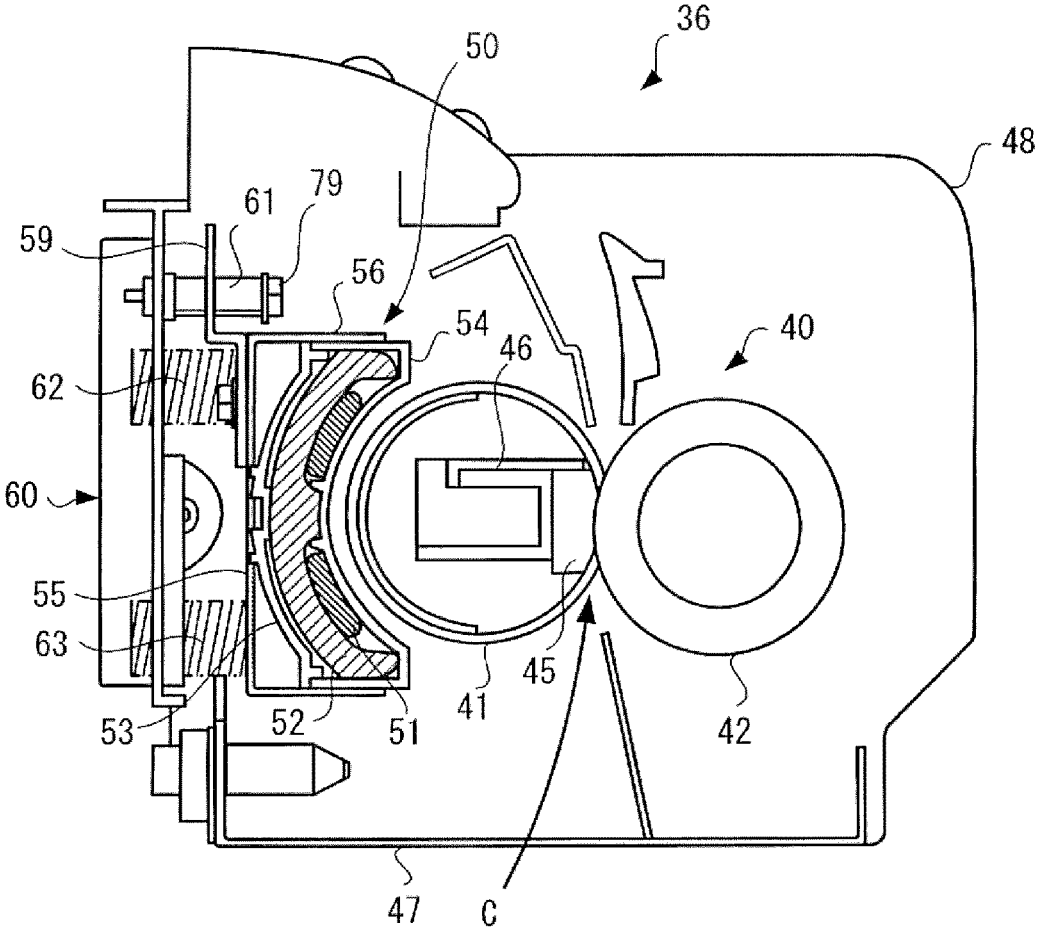
FIG. 7 is a sectional view showing the configuration of the main part of the fixing device.

FIG. 6 is a perspective view showing a state in which the fixing device shown in FIG. 5 is assembled. FIG. 7 is a sectional view showing the state in which the fixing device is assembled.

As shown in FIGS. 6 and 7, the IH coil unit 50 is attached such that the center shaft 61 of the plate 60 pierces through the long hole 591 of the bracket 59. If the center shaft 61 pierces through the bracket 59, a center position of the IH coil unit 50 with respect to the plate 60 is determined. A screw 79 is tightened to the distal end of the center shaft 61, which pierces through the bracket 59, to prevent the IH coil unit 50 from coming off the center shaft 61.

The positions of the fins 57 of the IH coil unit 50 and the erected pieces 64 of the plate 60 are aligned. The stepped screws 78 are tightened in the screw holes 571 and the screw holes 641. The springs 62 of the plate 60 are pushed and compressed by the IH coil unit 50.

In this state, the IH coil unit 50 is floated from the plate 60 by the springs 62. The IH coil unit 50 can support the own weight of the IH coil unit 50 with the bracket 59, through which the center shaft 61 pierces, and slightly move in the vertical direction with respect to the plate 60. Further, the IH coil unit 50 can be slightly moved in the rotating direction in a length range of the long holes 571 of the fins 57 using the center shaft 61 as a fulcrum.

After the IH coil unit 50 is provisionally fixed to the plate 60 in this way, the fuser unit 40 is attached to the plate 60. The fuser unit 40 is attached to the plate 60 by an ancillary attaching mechanism. As the attaching mechanism, an attaching mechanism having any structure can be used.

If the fuser unit 40 is attached to the plate 60, the shafts 71 of the inserters 70 fixed to the frame 47 enter the bearings 76 of the receivers 75. Further, since the shafts 72 hit the receiving sections 77, the IH coil unit 50 is restricted from turning using the center shaft 61 as the fulcrum. The IH coil unit 50 is also restricted from moving in the vertical direction with respect to the plate 60.

In this state, the springs 62 urge the IH coil unit 50 to be pushed back in the opposite direction of an attaching direction of the fuser unit 40. The shafts 71 and 72 of the inserters 70 surely collide with the bearings 76 and the receiving sections 77 of the receivers 75 with an urging force of the springs 62. Therefore, relative positions of the IH coil unit 50 and the fuser unit 40 are stabilized.

Figure 8A:
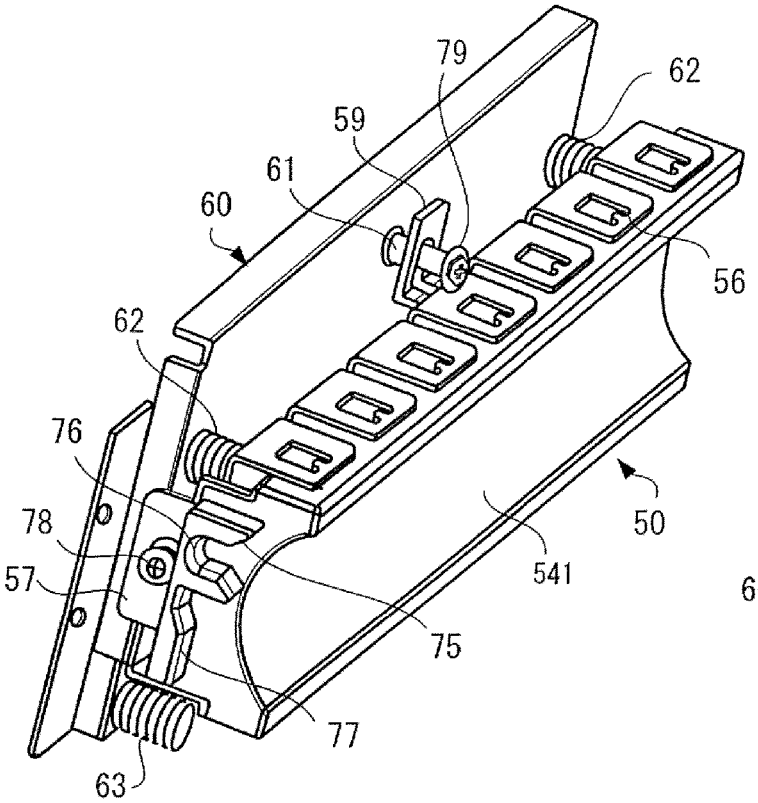
FIGS. 8A and 8B are a perspective view and a partial enlarged sectional view showing a state in which the IH coil unit is provisionally fixed.

FIG. 8A is a perspective view showing a state in which the IH coil unit 50 is provisionally fixed to the plate 60. As shown in FIG. 8A, the center shaft 61 of the plate 60 pierces through the long hole 591 of the bracket 59 of the IH coil unit 50. The screw 79 is tightened to the distal end of the center shaft 61. Consequently, a center position of the IH coil unit 50 with respect to the plate 60 is determined. However, translation in the longitudinal direction of the IH coil unit 50 with respect to the plate 60 is restricted.

The fins 57 of the IH coil unit 50 are attached to the erected pieces 64 of the plate 60 by the stepped screws 78. Therefore, the IH coil unit 50 can be slightly moved in the rotating direction in the length range of the long holes 571 of the fins 57 using the center shaft 61 as the fulcrum.

Figure 8B:
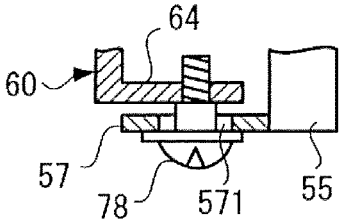

FIG. 8B is a sectional view showing a coupled state of the fins 57 and the erected pieces 64 of the plate 60. The stepped screws 78 include step sections having a large diameter and screw sections having a small diameter at the distal ends of the step sections. The width in a latitudinal direction of the long holes 571 is slightly larger than the diameter of the step sections of the stepped screws 78. Therefore, even if the stepped screws 78 are attached to the erected pieces 64, the IH coil unit 50 can slightly move in the vertical direction with respect to the plate 60. That is, the movement in the rotating direction and the vertical direction of the IH coil unit 50 can be allowed in a range set in advance.

Figure 9:
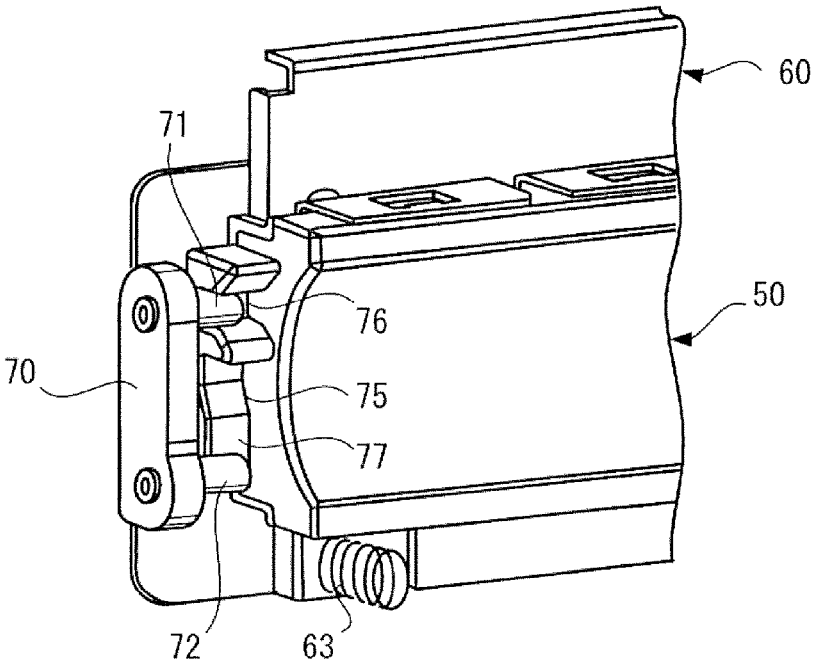
FIG. 9 is a partially enlarged perspective view showing a state in which the IH coil unit and the fuser unit are coupled.

FIG. 9 is a partially enlarged perspective view of apart of FIG. 8A showing a state in which the IH coil unit 50 and the fuser unit 40 are coupled. As shown in FIG. 9, if the fuser unit 40 is attached to the plate 60, the shafts 71 of the inserters 70 enter the bearings 76 of the receivers 75. Therefore, the IH coil unit 50 is restricted from turning using the center shaft 61 as the fulcrum. Since the shafts 72 hit the receiving sections 77 and press the receiving sections 77, the IH coil unit 50 is also restricted from moving in the vertical direction with respect to the plate 60.

Therefore, the IH coil unit 50 is accurately positioned with respect to the plate 60. The position of the fuser unit 40 with respect to the IH coil unit 50 is also accurately determined.

Note that the fuser unit 40 is attached to the plate 60 by the attaching mechanism. However, if the fuser unit 40 is detached from the plate 60, the attaching mechanism is unlocked. If the attaching mechanism is unlocked, the fuser unit 40 is uncoupled from the plate 60, pushed out by the springs 63, and easily detached.

The embodiment explained above is only an example. Other modifications are conceivable.

For example, in the embodiment, in the receivers 75, the bearings 76 are formed on the upper side and the receiving sections 77 are formed on the lower side. However, the receiving sections 77 may be formed on the upper side and the bearings 76 may be formed on the lower side. In this case, the positions of the shafts 71 and 72 of the inserters 70 are also reversed.

The inserters 70 may be fixed to both the end portions in the longitudinal direction of the IH coil unit 50. The receivers 75 may be fixed to both the side surfaces 472 and 473 of the frame 47 of the fuser unit 40. In this case, if the fuser unit 40 is attached to the plate 60, the inserters 70 fixed to the IH coil unit 50 are coupled to the receivers 75 fixed to the fuser unit 40. Therefore, the IH coil unit 50 is restricted by the receivers 75 from turning using the center shaft 61 as the fulcrum. The IH coil unit 50 is also restricted from moving in the vertical direction with respect to the plate 60.

The springs 62 and 63 are not limited the coil springs and may be springs having repulsion such as leaf springs.

As shown in FIG. 3, a fastener 49 having a hole may be provided at a front end portion of the cover 48 of the fuser unit 40. The length of the center shaft 61 may be set sufficiently large and the distal end of the center shaft 61 maybe slightly sharpened to stick into the hole of the fastener 49. In this example, the center shaft 61 can be used for not only positioning of the IH coil unit 50 but also positioning of the fuser unit 40. Therefore, a configuration for the positioning can be simplified and positioning fluctuation can be reduced.

As explained above, in the fixing device according to the embodiment, the IH coil unit 50 is provisionally fixed to the plate 60 in a floating state. The IH coil unit 50 is configured to be capable of moving relatively freely within a range set in advance. If the fuser unit 40 is attached, the fuser unit 40 and the IH coil unit 50 can be accurately positioned. Therefore, it is possible to smoothly attach the fuser unit 40 while positioning the fuser unit 40 with respect to the IH coil unit 50.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device comprising:

a fuser unit including a cylindrical rotating body;

a heating unit disposed along a longitudinal direction of the rotating body and configured to heat the rotating body;

a plate to which the heating unit and the fuser unit can be attached;

a supporting shaft provided on the plate to extend in a direction toward the heating unit;

a bracket provided in the heating unit and configured to support, on the supporting shaft, a center portion in the longitudinal direction of the heating unit and allow the heating unit to move in a rotating direction using the supporting shaft as a fulcrum and move in a vertical direction with respect to the plate; and positioning members including receivers provided at both end portions in the longitudinal direction of one unit of the heating unit and the fuser unit and inserters provided in positions of the other unit opposed to the receivers, wherein if the fuser unit is attached to the plate, the inserters are coupled to the receivers to restrict the heating unit from moving in the rotating direction and the vertical direction, and wherein the inserters of the positioning members include first shafts and second shafts provided at both end portions in the longitudinal direction of the other unit projecting in parallel, and the receivers include bearing sections provided at both end portions in the longitudinal direction of the one unit, the first shafts fitting in the bearing sections, and receiving sections with which the second shafts collide.

2. The device according to claim 1, wherein the bracket includes a hole through which the supporting shaft pierces, the hole being formed in a shape for restricting the heating unit from translating in the longitudinal direction with respect to the plate if the supporting shaft pierces through the hole.

3. The device according to claim 1, further comprising a spring member disposed between the plate and the heating unit and configured to support the heating unit in a floating state from the plate.

4. The device according to claim 1, further comprising fin members provided in the heating unit and configured to support both the end portions in the longitudinal direction of the heating unit on the plate and allow the heating unit to move in the rotating direction and the vertical direction within a range set in advance.

5. The device according to claim 4, wherein the fin members include long holes for allowing the heating unit to move in the rotating direction and the vertical direction and are attached to the plate by stepped screws.

6. The device according to claim 1, wherein the supporting shaft extends in a direction toward the heating unit and the fuser unit, the fuser unit includes a fastener through which a distal end of the supporting shaft pierces, and the fuser unit is positioned with respect to the plate by the supporting shaft.

7. The device according to claim 1, wherein the fuser unit includes:

a rotatable cylindrical fixing belt configured to heat and melt a toner image formed on a recording medium; and a pressurizing rotating member disposed to be opposed to the fixing belt along an axial direction of the fixing belt and configured to rotate together with the fixing belt and convey the recording medium, and the heating unit includes an electromagnetic induction heating coil configured to heat the fixing belt.

8. An image forming apparatus comprising:

an image forming section configured to form a toner image on a recording medium;

a fuser unit provided further on a downstream side in a sheet conveying direction than the image forming section and including a cylindrical rotating body;

a heating unit disposed along a longitudinal direction of the rotating body and configured to heat the rotating body;

a plate to which the heating unit and the fuser unit can be attached;

a supporting shaft provided on the plate to extend in a direction toward the heating unit;

a bracket provided in the heating unit and configured to support, on the supporting shaft, a center portion in the longitudinal direction of the heating unit and allow the heating unit to move in a rotating direction using the supporting shaft as a fulcrum and move in a vertical direction with respect to the plate; and positioning members including receivers provided at both end portions in the longitudinal direction of one unit of the heating unit and the fuser unit and inserters provided in positions of the other unit opposed to the receivers, wherein if the fuser unit is attached to the plate, the inserters are coupled to the receivers to restrict the heating unit from moving in the rotating direction and the vertical direction, and wherein the inserters of the positioning members include first shafts and second shafts provided at both end portions in the longitudinal direction of the other unit projecting in parallel, and the receivers include bearing sections provided at both end portions in the longitudinal direction of the one unit, the first shafts fitting in the bearing sections, and receiving sections with which the second shafts collide.

9. The apparatus according to claim 8, further comprising a spring member disposed between the plate and the heating unit and configured to support the heating unit in a floating state from the plate.

* * * * *